United States Patent [19]

Matsubayashi et al.

[11] Patent Number: 4,762,245

[45] Date of Patent: Aug. 9, 1988

[54] EASY-OPEN CAN LID

[75] Inventors: Hiroshi Matsubayashi, Kamakura; Naoto Watanabe; Seishichi Kobayashi, both of Yokohama; Toshio Sue; Kazuo Taira, both of Tokyo, all of Japan

[73] Assignee: Toyo Seikan Kaisha, Ltd., Tokyo, Japan

[21] Appl. No.: 28,014

[22] Filed: Mar. 18, 1987

Related U.S. Application Data

[63] Continuation of Ser. No. 769,718, Aug. 27, 1985, abandoned.

[30] Foreign Application Priority Data

Aug. 28, 1984 [JP] Japan ..... 59-177548
May 22, 1985 [JP] Japan ..... 60-108379

[51] Int. Cl.[4] ..... F23Q 7/22

[52] U.S. Cl. ..... 220/269; 220/270; 428/64; 428/66

[58] Field of Search ..... 220/269, 270, 272, 273; 428/64, 66

[56] References Cited

U.S. PATENT DOCUMENTS 4,403,710 9/1983 Hirota et al. ..... 220/270
4,428,494 1/1984 Hirota et al. ..... 220/270

*Primary Examiner*—J. David Welsh
*Attorney, Agent, or Firm*—Sherman and Shalloway

[57] ABSTRACT

A score line defining a portion to be opened is formed on a chromated surface treated steel plate coated with an epoxy type primer so that the score line is cut to the middle of the steel plate in the thickness direction thereof, and an opening tab is bonded and secured to the portion to be opened of the steel plate through a bonding fulcrum composed of a thermoplastic adhesive consisting of amide recurring units and/or ester recurring units so that the push-tearing top end of the opening tab is located on the score line.

13 Claims, 3 Drawing Sheets

EASY-OPEN CAN LID

This application is a continuation, of application Ser. No. 769,718 filed Aug. 27, 1985, now abandoned.

BACKGROUND OF THE INVENTION (1) Field of the Invention

The present invention relates to an easy-open can lid. More particularly, the present invention relates to an easy-open can lid formed from a chromated surface treated steel plate, which is excellent in easy openability, corrosion resistance and resistance against compression deformation and which can be easily manufactured and is suitable for reclamation after use.

(2) Description of the Prior Art

An easy-open lid comprising a portion to be opened, which is defined by a score line (partially cut line), a rivet formed on this portion to be opened and a pulling tab secured to this rivet is widely used for a can for containing therein a drink such as cola, beer or juice. In this easy-open can lid, by pulling the tab, the portion to be opened is cut and taken out along the score line.

This easy-open can lid of the score-breakage type is excellent in the combination of sealing reliability and easy openability, but it still involves problems to be solved. More specifically, in the manufacture of a can lid of this type, severe processings such as scoring processing and riveting processing should be performed, and therefore, the material that can be used is limited to a material excellent in the processability, such as aluminum. Accordingly, even when a can body is composed of a surface-treated steel plate such as tin-free steel (TFS), an easy-open lid has to be formed of aluminum. From the viewpoint of prevention of can pollution or saving of resources, it is desirable to recover used can bodies and reclaim them. However, since lids are composed of a material different from that of can bodies, it is extremely difficult to reclaim used can bodies.

Moreover, an inner coating of a can lid is easily damaged by severe processing such as riveting processing, and therefore, when a corrosive content is filled and a severe treatment such as heat sterilization is carried out as in case of canned food, no satisfactory corrosion resistance can be obtained. This tendency is especially conspicuous in case of an easy-open can lid formed by using aluminum. Furthermore, when a content having a high sodium chloride concentration is filled, pitting corrosion is caused and problems such as leakage of the content or contamination with bacteria through piercing holes arise.

As means for obviating these problems involved in an aluminum can lid, there has been proposed an easy-open lid composed of a steel plate. However, in the steel lid, a force required for opening is larger than in an aluminum lid and opening of the lid is generally difficult. As means for reducing the opening force in a steel lid, a method in which a carbide powder having an average particle size of 2.0 to 8.0 $\mu$m is precipitated in the steel plate and voids acting as the stress-concentrating source are formed between base iron and carbide particles is proposed, for example, in Japanese Patent Publication No. 61815/82. Indeed, according to this proposal, the opening force is reduced, but the steel plate per se becomes brittle and the portion to be opened is separated from the lid at a stretch, and the hand or finger is readily hurt by the cut edge.

SUMMARY OF THE INVENTION

We found that when a method in which a chromated surface-treated steel plate coated with an epoxy type primer is used as the lid-constituting material and an opening tab is secured to a lid composed of this steel plate through a polyamide and/or polyester type adhesive is adopted instead of the conventional technique of subjecting a can lid to riveting processing and securing an opening tab through the formed rivet, opening from a score line can be performed very easily and assuredly and the corrosion resistance of the can lid is prominently improved.

It also was found that if a score line of a lid member, a specific adhesive layer and an opening tab are arranged in a specific positional relationship described in detail hereinafter, there can be obtained an easy-open can lid which is excellent in easy openability, corrosion resistance and resistance against compression deformation and which can be easily manufactured and is suitable for reclamation after use.

It also was found that this easy-open can lid can endure such a sterilization treatment as retort sterilization or hot filling and is valuable as a can lid for canned food containing sodium chloride or other corrosive component.

Moreover, we found that if among chromated surface treated steel plates as described above, a surface-treated steel plate having a relatively low carbon content and an elongation included within a specific range is selected and a score line having a specific residual thickness ratio is formed on this lid member and if this lid member is bonded to an opening tab through a specific adhesive, there can be obtained an easy-open can lid which is excellent in easy openability, corrosion resistance and resistance against compression deformation and which can be easily manufactured and is suitable for reclamation after use.

It is therefore a primary object of the present invention to provide an easy-open can lid composed of a surface-treated steel plate in which the above-mentioned defects of the conventional easy-open can lids are eliminated.

Another object of the present invention is to provide a can lid which has good easy openability and high corrosion resistance in combination and in which an opening tab is secured to a steel lid through an adhesive.

Still another object of the present invention is to provide an easy-open lid composed of a surface-treated steel plate in which since the initial opening force is relatively small and the opening force after the start of the opening is large to some extent, separation of an opening tab is prevented and abrupt separation of all of the portion to be opened from the lid can be prevented.

A further object of the present invention is to provide an easy-open lid which can endure a sterilization treatment such as retort sterilization or hot filling and is valuable as a can lid for canned food containing sodium chloride or other corrosive component.

In accordance with one fundamental aspect of the present invention, there is provided an easy-open can having on the periphery thereof a sealing compound-coated portion to be seamed with a flange of a can body and an easy-open mechanism on the inner side, said can lid comprising a lid member composed of a chromated surface treated steel plate coated with an epoxy type primer, a score line formed on the lid member to define a portion to be opened, which is cut to the middle of the steel plate in the thickness direction thereof, and an opening tab secured to the outer surface of the lid member at said portion to be opened through a bonding fulcrum formed of a thermoplastic adhesive consisting of amide recurring units and/or ester recurring units, said opening tab being located so that the push-tearing top end of the opening tab is positioned substantially on the score line.

In accordance with another aspect of the present invention, there is provided an easy-open can lid as set forth above, wherein the opening tab is formed so that the following requirement is satisfied:

$$W \geqq K \cdot d \cdot \sigma_B \cdot t^2 \quad (1)$$

wherein K is a constant having a value of 4 $kg^{-1}$, d stands for a distance (mm) between the score line and the bonding fulcrum, $\sigma_B$ stands for the tensile strength ($kg/mm^2$) of the surface-treated steel plate, t stands for the residual thickness (mm) of the lid member on the score line, and W stands for the width (mm) of the adhesive layer at the distance d from the score line.

In accordance with still another aspect of the present invention, there is provided an easy-open can lid excellent in easy openability and corrosion resistance as set forth above, wherein the chromated surface treated steel plate has a carbon content lower than 0.03% and an elongation of 1 to 20% and the ratio of the residual thickness of the lid member on the score line to the thickness of the chromated surface treated steel plate in the portion to be initially opened is in the range of from 0.10 to 0.40.

Incidentally, in the instant specification, all of "%" are by weight unless otherwise indicated.

Figure 1:
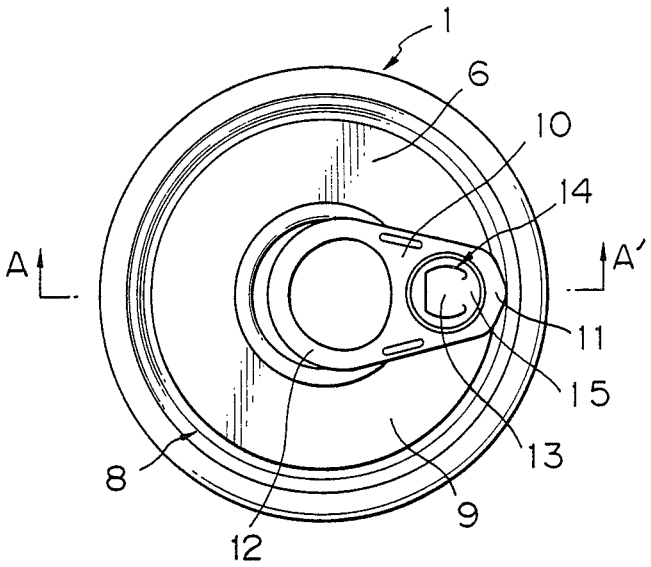
FIG. 1 is a top view illustrating an embodiment of the easy-open can lid according to the present invention.

In the drawings, reference numeral 1 represents an easy-open can lid, reference numeral 2 represents a primer coating, reference numeral 3 represents a chromated-surface-treated steel plate, reference numeral 8 represents a score line, reference numeral 9 represents a portion to be opened, reference numeral 10 represents an opening tab, reference numeral 13 represents a bonding point, and reference numeral 16 represents a thermoplastic resin adhesive layer.

DETAILED DESCRIPTION OF THE PREFERRED EMBODIMENTS

The present invention will now be described in detail with reference to preferred embodiments illustrated in the accompanying drawings.

STRUCTURE OF LID

Figure 2:
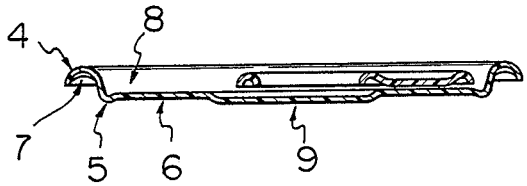
FIG. 2 is a view showing the section taken along the line A—A' in the can lid shown in FIG. 1.
Figure 3:
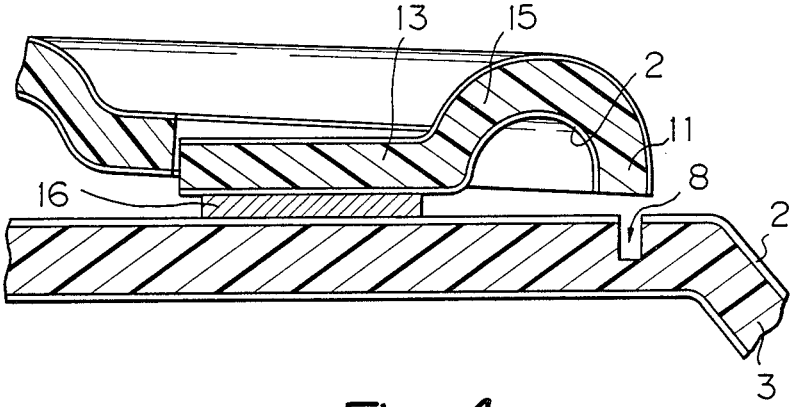
FIG. 3 is an enlarged view showing a main part of the section taken along the line A—A' in FIG. 1.

As shown in FIGS. 1, 2 and 3, the easy-open can lid 1 of the present invention is characterized in that the can lid 1 is composed of a surface-treated steel plate 3 having an epoxy type primer coating 2. In the present invention, chromate-treated steel plates, especially an electrolytically chromic acid-treated steel plate, a chromate-treated nickel-deposited steel plate, a chromate-treated iron/tin alloy-deposited steel plate, a chromate-treated tin/nickel alloy-deposited steel plate, a chromate-treated iron/tin/nickel alloy-deposited steel plate, a chromate-treated aluminum-deposited steel plate and a chromate-treated nickel/tin-deposited steel plate, are selected among various surface-treated steel plates and are preferably used as the surface-treated steel plate.

The reason why a surface-treated steel plate as described above is especially selected is that this surface-treated steel has a high rigidity inherent to steel and it can resist external deformation owing to a high vacuum produced in the interior as in case of a can for packing food, and this surface-treated steel plate has high corrosion resistance and excellent adhesion to a coating in combination.

This lid 1 has a circumferential groove 4 on the periphery and a panel portion 6 continuous to the groove 4 through an annular rim portion 5, and a sealing compound layer 7 to be sealed and engaged with a flange (not shown) of a can body at the double-seaming step is formed on the groove 4. A portion 9 to be opened, which is defined by a score line 8, is located on the inner side of the annular rim portion 5. This portion 9 to be opened may occupy substantially all of the panel portion 9 or may form a part of the panel portion. As shown in the enlarged sectional view of FIG. 3, the score line 8 is cut to the midway of the surface-treated steel plate 3 in the thickness direction thereof, and at the time of opening, shearing can be easily performed along the score line 8 in a manner described in detail hereinafter.

According to the present invention, an opening tab 10 is attached to the portion 9 to be opened in a special manner as described hereinafter.

This opening tab 10 has a top end 11 for push-tearing the score line on one end, a holding portion (ring) 12 on the other end and a fulcrum portion 13 located between both the ends and bonded to the lid. In this embodiment, the fulcrum portion 13 is formed in a tongue-like shape so that a substantially U-shaped cut 14 is formed on the tab between the top end 11 and the ring 12 and a connecting portion 15 is present between the fulcrum portion 13 and the top end 11. The push-tearing top end 11 of the opening tab 10 is heat-bonded to the portion 9 to be opened of the lid member at the tongue-shaped fulcrum portion 13 through a layer 16 of a thermoplastic resin adhesive consisting of amide recurring units and/or ester recurring units so that the position of the push-tearing top end 11 is substantially in agreement with the position of the score line 8 of the lid member.

The easy-open lid of the present invention is characterized in that the epoxy primer coating 2 is present on the chromated surface treated steel plate substrate 3 and the opening tab 10 is bonded and secured through this primer coating 2 and the polyester and/or polyamide type adhesive layer 16. The combination of the epoxy primer coating film 2 and the chromate treatment surface layer gives a highest corrosion resistance to the steel substrate and guarantees a highest coating adhesion, and the combination of the epoxy primer coating 2 and the polyamide and/or polyester type thermoplastic adhesive layer 16 guarantees that the bonding fulcrum 13 is not destroyed when an opening force necessary for shearing the score line 8 is applied.

In accordance with a preferred embodiment of the present invention, the bonding fulcrum is formed with a width (W) satisfying the requirement represented by the above-mentioned formula (1).

In the can lid of the present invention, when the ring 12 of the opening tab 10 is picked up between fingers and is lifted up, the lifting force is transferred as a downward force to the push-tearing top end 11 through the fulcrum portion 13, and a downward push-tearing force is applied to the score line 8 and simultaneously, a plucking force is imposed on the adhesive layer 16 between the fulcrum portion 13 and the portion 9 to be opened. The above-mentioned formula (1) is an empirical formula derived from the following facts: (i) this plucking force is increased with increase of the distance d between the score line 8 and the bonding fulcrum 13, (ii) the plucking force is increased with increase of the tensile strength $\sigma_B$ of the surface-treated steel plate 3 and (iii) the plucking force is in proportion to the square of the residual thickness t on the score line 8. From the graph of FIG. 4, it will be understood that in order to perform the opening operation smoothly, it is important that the width (W) of the adhesive layer at the bonding fulcrum is determined so that the requirement of the formula (1) is satisfied.

Figure 4:
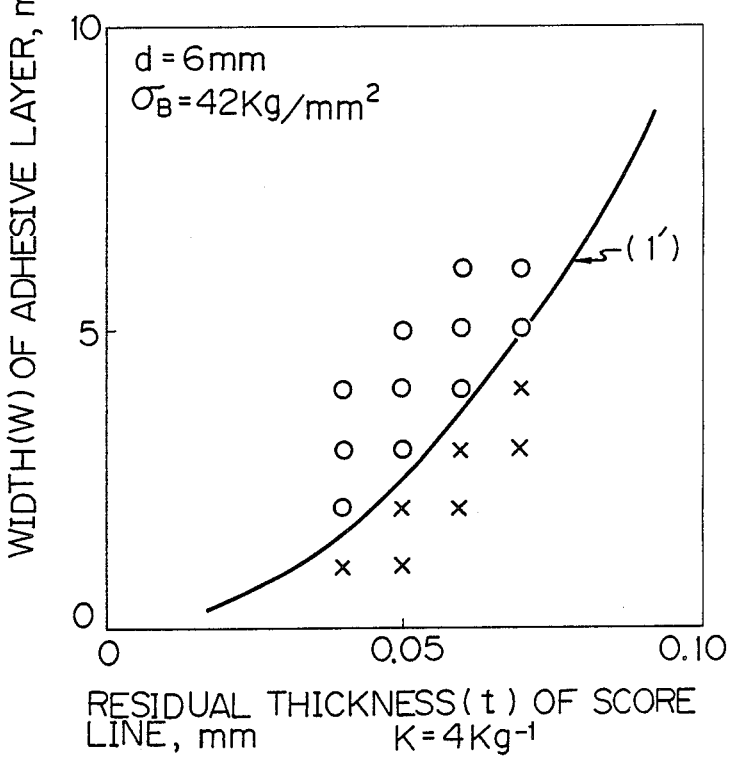
FIG. 4 is a diagram in which the residual thickness (t) on the score line is plotted on the abscissa and the width (W) of the adhesive layer is plotted on the ordinate, wherein marks "X" indicate points where peeling of the adhesive is caused at the time of opening and marks "○" indicate points where peeling of the adhesive is not caused at the time of opening.

In FIG. 4, results of experiments conducted by using an electrolytically chromic acid-treated steel plate coated with an epoxy-phenolic primer and a nylon 12-type adhesive while adjusting the distance d to 6 mm are shown. The residual thickness (t) on the score line and the width (W) of the adhesive layer are plotted on the abscissa and the cordinate, respectively. In FIG. 4, curve 1' corresponds to $W=K\cdot d\cdot\sigma_B\cdot t^2$, and marks "○" indicate points where the scope line 8 is smoothly broken without substantial peeling of the adhesive layer 16 and marks "X" indicate points where peeling of the adhesive layer 16 is caused before breakage of the score line 8. From the results shown in FIG. 4, it is seen that in order to give an easy openability to a lid composed of a surface-treated steel plate having a high rigidity, it is critical that the width (W) of the adhesive layer at the bonding fulcrum should satisfy the requirement represented by the formula (1).

In connection with breakage of a lid composed of a surface-treated steel plate having a rigidity along a score line, as taught in Japanese Utility Model Publication No. 524/76, if an opening tab is heat-bonded to a portion to be opened, only by pulling this opening tab, even formation of a cut on the score line is difficult. It is absolutely necessary to first form a cut on the score line by downwardly pressing the score line by a sharp top end and in order for the adhesive layer to resist the plucking force to be applied to the adhesive layer when the cut is formed on the score line, it is important that the width (W) of the adhesive layer should be determined so that the requirement of the formula (1) is satisfied. Moreover, it is indispensable that a chromated surface treated steel plate should be used as the metal material, an epoxy type primer should be used for the primer coating and an adhesive composed of amide recurring units and/or ester recurring units should be used. For example, in case of a steel plate having a free metallic tin layer such as tinplate, bonding failure is caused when a cut is formed on the score line, and when a heat adhesive other than a polyamide and/or polyester type adhesive, for example, an acid-modified olefin resin, is used, bonding failure is often caused when a cut is formed on the score line.

Once a cut is formed on the score line 8 of the lid member, breakage is smoothly advanced along the score line 8 by pulling the tab. Accordingly, only formation of an initial cut on the score line 8 is important.

In the present invention, the bonding width of the tab is adjusted so that the requirement of the formula (1) is satisfied. This does not mean that the bonding width between the tongue piece as the bonding fulcrum and the lid member, that is, the width of the adhesive in the direction rectangular to the longitudinal direction of the tab, should always be the width W satisfying the above requirement along the entire longitudinal direction of the tab, but it is sufficient if the width of the adhesive is the width W satisfying the requirement of the formula (1) only along a part of the longitudinal direction of the tab. Ordinarily, if the portion of the width W satisfying the requirement of the formula (1) continues at least 0.3 mm in the longitudinal direction of the tab, sufficiently strong bonding can be attained.

In accordance with a most preferred embodiment of the present invention, a chromated surface treated steel plate having a carbon content lower than 0.03%, especially lower than 0.02%, and an elongation of 1 to 20%, especially 1 to 15%, is used. By the term "elongation" used herein is meant the elongation at break obtained at the tensile test. When the elongation differs according to the direction, the mean value of the elongation in the rolling direction of the steel plate, the elongation in the direction of 45° to the rolling direction and the elongation in the direction of 90° to the rolling direction is used as the elongation of the steel plate.

Namely, the surface-treated steel plate of the present invention is characterized in that although the carbon content is considerably low, the elongation is controlled to a low level. By dint of this characteristic feature, an excellent easy openability can be obtained. The crystal texture of the steel plate of the present invention is a rolled aggregate texture (elongated grains), and in this crystal texture, it is impossible to reduce the critical residual thickness on the score line and the residual score thickness can be made much smaller than in the conventional techniques.

Figure 5:
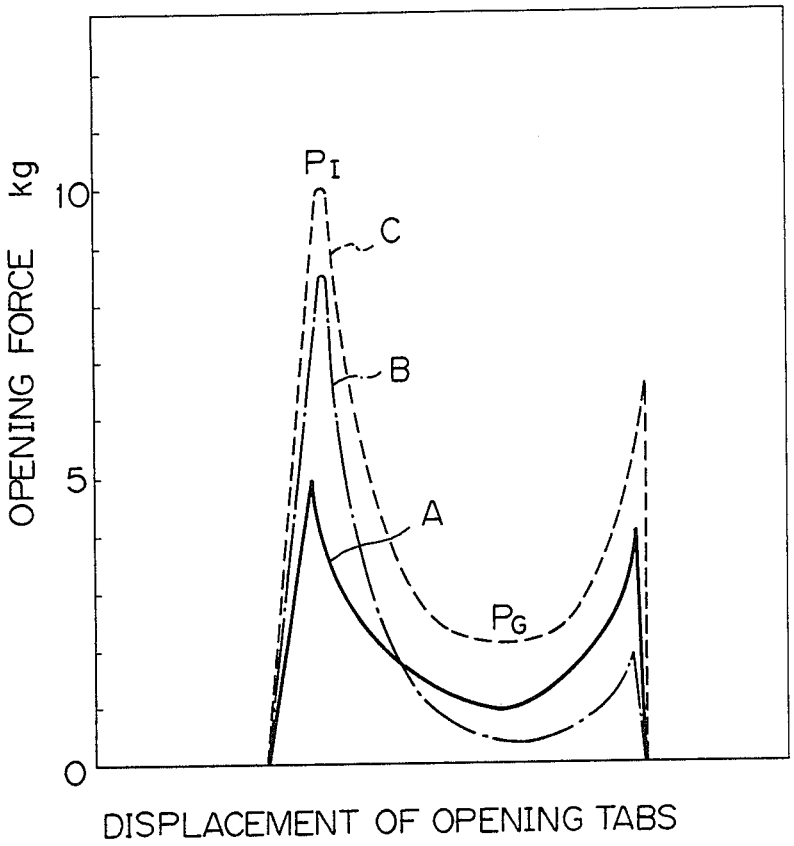
FIG. 5 is a graph in which with respect to various easy-open can lids, displacements of opening tabs are plotted on the abscissa and opening forces are plotted on the ordinate.

In connection with a full-open type easy-open can lid having a shape and structure shown in FIGS. 1 through 3, a cut is formed by pushing the top end of the opening tab and then, the opening tab is pulled up. In FIG. 5, the quantity of displacement of the opening tab and the opening force are plotted on the abscissa and the ordinate, respectively. In FIG. 5, curve A shows the results obtained when a surface-treated steel plate having a carbon content of 0.01% and an elongation of 8% is used according to the present invention, curve B shows the results obtained when a surface-treated steel plate taught in Japanese Patent Publication No. 61815/82 in which the carbon content is 0.07% by weight and carbide particles are coarsened is used, and curve C shows the results obtained when a surface-treated steel plate taught in Japanese Patent Publication No. 5333/76 in which the carbon content is controlled to such a low level as 0.01% and which is subjected to a skin-pass roll treatment is used. Incidentally, the last-mentioned steel plate has an elongation of 35%. Referring to FIG. 5, when the quantity of displacement of the opening tab (quantity of pull-up displacement), a largest opening force is necessary at the initial stage of pulling where the ratio of the shearing expansion in the lateral direction between two scores is large, and then, the opening force is abruptly reduced and comes close to a certain value and finally, the opening force is somewhat increased before complete shearing. Thus, the opening operation is completed. As is seen from FIG. 5, according to this preferred embodiment of the present invention, the initial opening force ($P_I$) can be controlled to a much smaller level than in case of surface-treated steel plates B and C heretofore proposed as steel plates for can lids, and the gradual opening force ($P_G$) can be made larger than in the conventional surface-treated steel plate. This means that a large opening force is necessary at the start of opening in the conventional surface-treated steel plates B and C for can lids and the opening operation per se is difficult, while according to the present invention, the initial opening force can be reduced and the opening operation can be facilitated. Moreover, in case of the surface-treated steel plate B, since the initial opening force ($P_I$) is extremely large and the gradual opening force ($P_G$) is considerably small, the portion to be opened is separated from the can lid at a stretch and fingers are readily hurt by the cut edge. In contrast, in case of the lid A of the present invention, since the initial opening force ($P_I$) is relatively small and the gradual opening force ($P_G$) is somewhat large, the portion to be opened is relatively persistent and gradual shearing is possible. Incidentally, in case of the conventional can lid C, since the gradual opening force ($P_G$) is too large, in the actual opening operation, it is felt that opening is difficult. It has been experimentally confirmed that in view of the easy openability, it is preferred that the initial opening force ($P_I$) be 2.5 to 7.5 kg and the gradual opening force ($P_G$) be 0.5 to 2.0 kg, though preferred values differ to some extent according to the size of the can and the size and shape of the score line.

In the present invention, the carbon content of the steel substrate is lower than 0.03%, especially lower than 0.02%. This means that formation of the carbide is substantially inhibited. Accordingly, if the carbon content is higher than 0.03%, defects as observed in the conventional can lid B are caused to appear. Furthermore, if the elongation of the surface-treated steel plate is lower than 1%, the score-forming operation becomes difficult and cracks are readily formed in the score portion. If the elongation exceeds 20%, both the initial opening force and the gradual opening force are large as in the conventional can lid C.

In the present invention, it is preferred that the ratio $t_1/t_0$ of the residual thickness $t_1$ on the score line to the thickness $t_0$ of the surface-treated steel plate in the portion to be initially opened (the portion on which the top end of the tab described hereinafter is overlapped) be in the range of from 0.10 to 0.40, especially from 0.12 to 0.30, particularly especially from 0.15 to 0.25. This thickness ratio ($t_1/t_0$) is important from the viewpoints of sealing property, corrosion resistance and easy openability, and if this ratio is below the above-mentioned range, the residual score thickness cannot be stably obtained and cracks are readily formed in the scored portion or scores are often extended to the inner surface. If the thickness ratio exceeds the above range, a large opening force becomes necessary and the easy openability is degraded.

In the present invention, since the surface-treated steel plate coated with an epoxy type primer is used as the lid member, a satisfactory corrosion resistance can be obtained even to a content containing sodium chloride at a high concentration and a sufficient resistance to compression deformation can be obtained even if the pressure difference between the inside and outside of the can is large.

Since the above-mentioned surface-treated steel plate has a long elongation, it is difficult to secure the opening tab by a rivet formed by riveting processing. According to the present invention, however, by using a thermoplastic adhesive consisting of amide recurring units and/or ester recurring units as main recurring units and combining this specific adhesive with the above-mentioned surface-treated steel plate coated with an epoxy type primer, the opening tab can be secured by bonding with excellent adhesion strength, high resistance to hot water and good resistance to deterioration with the lapse of time. In fact, according to the present invention, an adhesion strength exceeding 3 kg/5 mm can be obtained.

As means for securing the tab, there can be mentioned soldering, electric resistance welding and ultrasonic welding in addition to bonding. However, when these methods are adopted, the inner surface coating and surface treatment film of the lid at the tab-securing position undergo thermal and mechanical damages, and hence, a lid excellent in the resistance to a content cannot be obtained.

The thermoplastic adhesive composed mainly of amide recurring units and/or ester recurring units, which is used in the present invention, can secure the tab by bonding at a temperature lower than the level giving thermal damages to an ordinary inner surface coating for a can, and therefore, a lid excellent in the resistance to a content can be provided according to the present invention.

CONSTITUENT MATERIALS

As pointed out hereinbefore, chromated surface treated steel plates such as an electrolytically chromic acid-treated steel plate, a chromate-treated nickel-plated steel plate, a chromate-treated iron/tin alloy-plated steel plate, a chromate-treated tin/nickel alloy-plated steel plate, a chromate-treated iron/tin nickel alloy-plated steel plate, a chromate-treated aluminum-plated steel plate and a chromate-treated nickel/tin-plated steel plate are preferably used as the surface-treated steel plate.

The electrolytically chromic acid-treated steel plate comprises a cold-rolled steel plate substrate, a metallic chromium layer formed on the substrate and a non-metallic chromium layer formed on the metallic chromium layer. The thickness of the steel plate substrate is determined while taking resistance to compression deformation, processability and easy openability into consideration, and it is ordinarily preferred that the thickness of the steel plate substrate be 0.10 to 0.40 mm, especially 0.12 to 0.35 mm. The thickness of the metallic chromium layer is determined in view of corrosion resistance and processability, and it is preferred that the amount deposited of chromium be 30 to 300 mg/m$^2$, especially 50 to 250 mg/m$^2$. The thickness of the non-metallic chromium layer has influences on adhesion or bonding peel strength of a coating, and it is preferred that the amount plated of chromium be 4 to 40 mg/m$^2$, especially 7 to 30 mg/m$^2$.

The chromate-treated nickel-plated steel plate comprises a cold-rolled steel plate substrate, a nickel layer formed on the substrate and a chromate layer formed on the nickel layer. The thickness of the nickel layer has influences on corrosion resistance, and it is preferred that the amount plated of nickel be 30 to 3000 mg/m$^2$, especially 100 to 1000 mg/m$^2$. The chromate layer may comprise a non-metallic chromium layer alone or it may further contain a metallic chromium layer. The thickness of the chromate layer has influences on adhesion and bonding peel strength of a coating, and it is preferred that the amount plated of chromium be 3 to 200 mg/m$^2$, especially 5 to 150 mg/m$^2$.

The chromate-treated iron/tin alloy-plated steel plate comprises a cold-rolled steel plate substrate, an iron/tin alloy layer formed on the substrate layer and a chromate layer formed on the alloy layer. The thickness of the iron/tin alloy layer has influences on corrosion resistance, and it is preferred that the amount plated of the alloy as calculated as the amount of tin be 30 to 800 mg/m$^2$, especially 200 to 700 mg/m$^2$. The chromate layer may comprise a non-metallic chromium layer alone or it may further contain a metallic chromium layer. The chromate layer has influences on adhesion or bonding peel strength of a coating, and it is preferred that the amount plated of chromium be 3 to 200 mg/m$^2$, especially 5 to 150 mg/m$^2$.

The chromate-treated tin/nickel alloy-plated steel plate comprises a cold-rolled steel substrate, a tin/nickel alloy layer formed on the substrate and a chromate layer formed on the alloy layer. The thickness of the tin/nickel alloy layer has influences on corrosion resistance, and it is preferred that the amount plated of the alloy as calculated as the amount of tin be 30 to 800 mg/m$^2$, especially 50 to 500 mg/m$^2$. The chromate layer may comprise a non-metallic chromium layer alone or it may further contain a metallic chromium layer. The thickness of the chromate layer has influences on adhesion or bonding peel strength of a coating, and it is preferred that the amount plated of chromium be 3 to 200 mg/m$^2$, especially 5 to 150 mg/m$^2$. A small amount of iron, manganese, zinc, molybdenum or copper may be incorporated into the tin/nickel alloy layer so as to improve the corrosion resistance. Furthermore, a nickel layer or tin layer may be formed between the steel plate and the tin/nickel alloy layer.

The chromate-treated iron/tin/nickel alloy-plated steel plate comprises a cold-rolled steel plate substrate, an iron/tin/nickel alloy layer formed on the substrate and a chromate layer formed on the alloy layer. The thickness of the iron/tin/nickel alloy layer has influences on corrosion resistance, and it is preferred that the amount plated of the alloy layer as calculated as the amount of tin be 10 to 800 mg/m$^2$, especially 30 to 400 mg/m$^2$. The chromate layer may comprise a non-metallic chromium layer alone or it may further contain a metallic chromium layer. The thickness of the chromate layer has influences on adhesion or bonding peel strength of a coating, and it is preferred that the amount deposited of chromium be 3 to 200 mg/m$^2$, especially 5 to 150 mg/m$^2$. A small amount of manganese, zinc, molybdenum or copper may be incorporated into the iron/tin/nickel alloy layer so as to improve the corrosion resistance.

The chromate-treated aluminum-plated steel plate comprises a cold-rolled steel plate substrate, an aluminum layer formed on the substrate and a chromate layer formed on the aluminum layer. An iron/aluminum alloy layer may be formed between the steel plate and the aluminum layer. The thickness of the aluminum layer has influences on corrosion resistance, and it is preferred that the amount plated of aluminum be 30 to 3000 mg/m$^2$, especially 100 to 2500 mg/m$^2$. The chromate layer may comprise a non-metallic chromium layer alone or it may further contain a metallic chromium layer. The chromate layer may be a chromium phosphate layer. The thickness of the chromate layer has influences on adhesion or bonding peel strength of a coating, and it is preferred that the amount plated of chromium be 3 to 200 mg/m$^2$, especially 5 to 150 mg/m$^2$.

Steel substrates of these surface-treated steel plates, which have the carbon content and elongation within the above-mentioned preferred ranges, may be prepared according to the following process, though the preparation method is not limited to the method described below.

More specifically, a steel plate having the carbon content adjusted below 0.03 % by performing decarburization at the melting step by a vacuum degassing device, by performing pouring and hot rolling according to customary procedures and performing decarburization before primary cold rolling or by performing decarburization by box decarburization annealing after primary cold rolling is subjected to secondary cold rolling at a rolling ratio of 20 to 70%, whereby a steel plate having an elongation of 1 to 20% can be prepared. If the rolling ratio at the secondary cold rolling step is lower than 20%, the crystal texture of the steel plate is not sufficiently converted to a rolled aggregate texture and the critical residual thickness on the score line cannot be reduced to a satisfactory small value.

The strength of the surface-treated steel plate is ordinarily 32 to 63 kg/mm$^2$, preferably 35 to 60 kg/mm$^2$ and especially preferably 40 to 55 kg/mm$^2$. Any of known epoxy type lacquers having a good adhesion to a surface-treated steel plate as described above and an excellent bondability to a thermoplastic adhesive consisting of amide recurring units and/or ester recurring units may be used for formation of a primer coating. For example, there can be mentioned thermosetting and thermoplastic epoxy resin lacquers. As typical instances, there can be mentioned modified epoxy lacquers such as a phenol-epoxy lacquer, an epoxy-urea lacquer, an epoxy-melamine lacquer, an epoxy-acrylic lacquer, an epoxy-polyamide lacquer and an epoxy-ester lacquer, and epoxy-modified vinyl lacquers such as epoxy-modified, epoxyamino-modified and epoxy-phenol-modified vinyl chloride/vinyl acetate copolymers, partially saponified vinyl chloride/vinyl acetate copolymers and vinyl chloride/vinyl acetate/maleic anhydride copolymers.

As examples of the primer lacquer excellent in adhesion and corrosion resistance, there can be mentioned phenol-epoxy lacquers comprising a resol type phenol-aldehyde resin derived from a phenol and formaldehyde and a bis-phenol type epoxy resin. A phenol-epoxy lacquer comprising a phenolic resin and an epoxy resin at a weight ratio of from 90/10 to 5/95 is especially preferred. This lacquer is excellent in processability as well as adhesion and corrosion resistance and even if a primer coating of this lacquer is subjected to scoring processing, a high corrosion resistance is maintained in the scored portion. The lacquer of this type is especially suitable for bonding with a polyamide type adhesive.

As another examples of the primer lacquer excellent in adhesion and corrosion resistance, there can be mentioned epoxy-modified vinyl chloride copolymer resins. Lacquers of this type are prepared from an epoxyamino lacquer or epoxyphenol lacquer and a vinyl chloride copolymer optionally with a vinyl chloride homopolymer. As the vinyl chloride copolymer, there are used those having functional groups such as carboxyl, acid anhydride, amino or hydroxyl groups. Namely, lacquers of this type comprise a resin formed by copolymerizing vinyl chloride with acrylic acid, methacrylic acid, maleic anhydride or a hydroxypropyl or hydroxyethyl ester of acrylic acid or methacrylic acid, if necessary with other comonomer such as vinyl acetate. Hydroxyl groups may also be introduced by saponifying vinyl acetate units in the copolymer. The lacquer of this type is especially suitable for bonding with a polyester type adhesive.

The primer coating may have either a single layer structure or a multi-layer structure comprising, for example a base coat and a topcoat.

The thickness of the primer coating is not particularly critical, so far as the objects of the present invention can be attained. However, it is generally preferred that the thickness of the primer coating be 0.2 to 30 μm, especially 1 to 20 μm.

The opening tab may be prepared from the same chromated surface treated steel plate as that constituting the can lid or from a plate of a light metal such as aluminum or an aluminum alloy. When a plate of a light metal such as aluminum or an aluminum alloy is used, it is preferred that the plate be subjected to a surface treatment of the chromium phosphate or acrylic type. It is important that an epoxy type primer as described above with reference to the can lid should be coated on the metal material constituting the opening tab. The epoxy type primer coated on the opening tab is appropriately selected according to the kind of the metal material and need not be the same as the epoxy primer used for the lid member. A plastic material can also be used for the opening tab, if it has a sufficient rigidity.

Homopolyamides, copolyamides and copolyesters having a melting or softening point of 50° to 300° C., especially 80° to 270° C., or blends of two or more of them, are used as the thermoplastic adhesive resin comprising amide recurring units and/or ester recurring units.

Homopolyamides and copolyamides comprising 4 to 17 amide recurring units, especially 5 to 17 recurring units, per 100 carbon atoms are preferably used, and a copolyamide comprising at least 3 mole% of amide recurring units different from the main amide recurring units is especially preferred. As preferred examples of the polyamide, there can be mentioned nylon 13, nylon 12, nylon 11, nylon 6,12, nylon 6, nylon 6,6, nylon 6,10, nylon 12/nylon 6, nylon 12/nylon 10/nylon 6,12, nylon 6/nylon 6,6 and a dimer acid-based polyamide, though polyamides that can be used are not limited to those mentioned above.

Copolyesters comprising 3 to 70 mole% of ester recurring units different from the main ester recurring units are used. For example, there can be mentioned polyethylene terephthalate/isophthalate, polytetramethylene terephthalate/isophthalate, polyethylene terephthalate/adipate, polytetramethylene terephthalate/adipate and polytetramethylene/ethylene terephthalate/dodecanoate, though copolyesters that can be used are not limited to those mentioned above.

Of course, these adhesives should have a film-forming molecular weight. Blends of polyamides, blends of copolyesters and blends of polyamides and copolyesters may be used. Other resins, for example, ionomers, xylene resins and epoxy resins, may be blended for modification or the like. Moreover, known additives such as fillers, heat stabilizers, antioxidants, nucleating agents, pigments, plasticizers and lubricants may be incorporated into the adhesives according to known recipes.

PREPARATION PROCESS

In the preparation of the easy-open can lid of the present invention, a primer lacquer as mentioned above is applied in the form of an organic solvent solution, an aqueous dispersion or an aqueous solution on the above-mentioned surface-treated steel plate by such means as spray coating, roller coating, dip coating, electrostatic coating or electrophoresis coating, and a coating is formed by drying or baking.

The coated plate is punched in a predetermined can lid size and a can lid having a predetermined shape is formed by press forming. Simultaneously with or separately from this forming operation, scoring processing is carried out. It is preferred that the scoring processing be performed so that the ratio of the residual thickness of the scored portion to the thickness of the surface-treated steel plate is in the range of from 0.1 to 0.4, especially from 0.12 to 0.30, particularly especially from 0.15 to 0.25, and the absolute thickness of the scored portion is 20 to 80 μm, especially 25 to 70 μm.

Before or after this scoring processing, a sealing compound composition comprising a synthetic rubber latex such as a styrenebutadiene rubber latex, a tackifier and a filler is applied to the peripheral groove portion of the can lid and dried to form a compound layer.

A thermoplastic adhesive layer is formed on the fulcrum portion of the separately formed opening tab or on the portion of the can lid to which the opening tab is to be attached. Of course, the adhesive layer may be formed on both of the above-mentioned two portions. Formation of the adhesive layer may be accomplished by optional means. For example, an adhesive film cut in a predetermined size is applied, or the adhesive is applied in the form of a powder, melt, suspension or solution. It is preferred that the thickness of the adhesive layer be 3 to 150 μm, especialy 10 to 100 μm.

Then, the opening tab is positioned on the can lid, and the thermoplastic resin located between the fulcrum portion of the tab and the can lid is melted and then cooled and solidified to complete bonding of the tab and the can lid.

Incidentally, when the can lid is used for canned food, it is preferred that the score line be formed along the entire circumference in close proximity to the annular rim to form a so-called full-open can lid. An optional shape such as a waterdrop-like or semicircular shape may be given to the score line.

Before or after bonding the opening tab to the lid member, an organic resin film may be formed on the outer surface and/or inner surface of the lid member in the vicinity of the scored portion so as to prevent corrosion of the scored portion and/or prevent hurting of fingers by the cut edge.

USES

Since the lid member of the easy-open can lid of the present invention is formed of a chromated surface treated steel plate having a rigidity, even if the can lid is used for a can for canned food which is subjected to heating sterilization at a high temperature and in which vacuum is maintained after the sterilization, deformation is prevented. This is one of prominent advantages attained by the present invention.

Furthermore, since severe processing such as riveting processing is unnecessary for the production of the can lid of the present invention, a very cheap surface-treated steel plate can be used instead of aluminum, and since this surface-treated steel plate is used for the can lid, the material of the can lid becomes the same as that of the can body and reclamation of resources can be easily accomplished. This is another advantage attained by the present invention. Moreover, since this surface-treated steel plate is excellent in the corrosion resistance, there can be attained a sufficient corrosion resistance even to a content having a high sodium chloride concentration and the can lid of the present invention is valuable as a can lid for cans for packing various foods such as livestock products, processed livestock products, marine products, vegetables, vegetable and fruit juices and fruits.

The present invention will now be described in detail with reference to the following examples that by no means limit the scope of the invention.

In the following examples and comparative examples, the tests were conducted according to the following procedures.

(1) Openability Test

By pulling up the tab of an easy-open can, the scored portion was broken to effect opening. When the portion to be opened, defined by the score line, was separated from the can lid, it was judged that opening was possible. With respect to each sample, 100 can lids were tested, and the openability was evaluated by the number of the can lids where opening was possible.

(2) Stored Can Openability Test (I)

A can No. 7 having one end seamed with an easy-open can lid was filled with flavored bonito and an ordinary lid was vacuum-seamed on the other end of the can. The can was heat-sterilized at 116° C. for 90 minutes and stored at normal temperature for 1 year. Then, the same openability test as described in (1) above was carried out. The openability was evaluated by the number of the cans where opening was possible among 100 test cans.

(3) Stored Can Openability Test (II)

A can No. 7 having one end seamed with an easy-open can lid was filled with orange and an ordinary lid was vacuum-seamed on the other end of the can. The can was heat-sterilized at 82° C. for 12 minutes and stored at normal temperature for 1 year. Then, the same openability test as described in (1) above was carried out. The openability was evaluated by the number of the cans where opening was possible among 100 tested cans.

(4) Observation of Inner Face of Easy-Open Can Lid

With respect to each of the cans tested in the methods (2) and (3), the corrosion state of the inner face of the easy-open can lid before opening was observed by a stereomicroscope.

In Examples 1 through 6 and Comparative Examples 1 through 5, experiments were carried out by using various kinds of surface-treated steel plates while using the same primer and adhesive without changing the residual thickness on the score line, the distance between the score line and the bonding fulcrum, the width of the adhesive layer at the bonding fulcrum and the tensile strength of the used steel plate.

EXAMPLE 1

An epoxy-phenol lacquer (comprising 90% by weight of an epoxy resin and 10% by weight of a phenolic resin) was coated on both the surfaces of a commercially available, electrolytically chromic acid-treated steel plate (having a thickness of 0.23 mm and a tensile strength of 42.5 kg/mm$^2$) in which the amount plated of metallic chromium was 100 mg/m$^2$ and the amount plated of chromium in the non-metallic chromium layer was 15 mg/m$^2$, so that the thickness of the primer coating after drying was 5 $\mu$m, followed by baking at 210° C. for 10 minutes.

This primer-coated, electrolytically chromic acid-treated steel plate was formed into a lid having a nominal diameter of 211 by using a press. A sealing compound was coated and dried on a curl portion of the lid. The inner surface of the lid was score-processed in a circular shape having a diameter of 58 mm so that the residual thickness of the scored portion was 45 $\mu$m.

A tab composed of the same primer-coated, electrolytically chromic acid-treated steel plate as used for the lid was bonded at 220° C. to the so-obtained lid member by using a filmy adhesive of nylon 12 so that the distance between the score line and the bonding fulcrum was 6 mm and the width of the adhesive layer at the bonding fulcrum was 5 mm. The so-obtained easy-open can lid was subjected to the openability test, the stored can openability test and the observation of the inner face of the easy-open can lid. The obtained results are shown in Table 1.

EXAMPLE 2

A cold-rolled steel plate having a thickness of 0.23 mm and a tensile strength of 42.5 kg/mm$^2$ was subjected to alkali degreasing and pickling preliminary treatments according to customary procedures and nickel plating was carried out at a current density of 5 A/dm$^2$ in a watt solution (containing 250 g/l of nickel sulfate, 40 g/l of nickle chloride and 40 g/l of boric acid) maintained at 50° C. to form a nickel plating layer having a thickness corresponding to 300 mg/m$^2$. This nickel-plated steel plate was subjected to a cathodic electrolytic treatment in an aqueous solution containing 30 g/l of sodium dichromate to form a chromate film having a plated chromium amount of 8 mg/m$^2$.

By using the so-obtained chromate-treated nickel-plated steel plate, primer coating, lid formation, tab formation and tab bonding were carried out in the same manner as described in Example 1 to form an easy-open can lid, and the openability test, the stored can openability test and the observation of the corrosion state of the scored portion were conducted. The obtained results are shown in Table 1.

EXAMPLE 3

The same cold-rolled steel plate as used in Example 2 were subjected to alkali degreasing and pickling preliminary treatments according to customary procedures and was then subjected to tin plating at a current density of 30 A/dm$^2$ and a bath temperature of 45° C. in a tin plating solution containing 60 g/l of stannous sulfate, 60 g/l of phenol-sulfonic acid, 10 g/l of sulfuric acid and 1 l of water to form a tin plating layer having a thickness corresponding to a plated tin amount of 500 mg/m$^2$. Then, the steel plate was heat-treated at 250° C. for 5 seconds to obtain an iron/tin alloy-plated steel plate. Then, this iron/tin alloy-plated steel plate was subjected to a cathodic electrolytic treatment in an aqueous solution containing 30 g/l of sodium dichromate to form a chromate film having a plated chromium amount of 7 mg/m$^2$.

By using the so-obtained chromate-treated iron/tin alloy-plated steel plate, primer coating, lid formation, tab formation and tab bonding were carried out in the same manner as described in Example 1, and the openability test, the stored can openability test and the observation of the corrosion state of the scored portion were conducted. The obtained results are shown in Table 1.

EXAMPLE 4

The same cold-rolled steel plate as used in Example 2 was subjected to tin plating in the same manner as described in Example 3 to form a tin plating layer having a thickness corresponding to 500 mg/m$^2$. Then, nickel plating was carried out under the same conditions as described in Example 2 to form a nickel plating layer having at thickness corresponding to 300 mg/m$^2$. Then, the steel plate was heat-treated at 180° C. for 1 second to obtain a tin/nickel alloy-plated steel plate. Then, this tin/nickel alloy-plated steel plate was subjected to a cathodic electrolytic treatment in an aqueous solution containing 30 g/l of sodium dichromate to form a chromate film having a deposited chromium amount of 8 mg/m$^2$.

By using the so-obtained chromate-treated tin/nickel alloy-plated steel plate, an easy-open can lid was prepared in the same manner as described in Example 1. The same tests as described in Example 1 were conducted in the same manner. The obtained results are shown in Table 1.

EXAMPLE 5

The same cold-rolled steel plate as used in Example 2 was treated in the same manner as described in Example 4 except that the heat treatment after nickel plating was conducted at 250° C. for 2 seconds. The obtained iron/-tin/nickel alloy-plated steel plate was subjected to a cathodic electrolytic treatment in an aqueous solution containing 30 g/l of sodium dichromate to form a chromate film having a plated chromium amount of 10 mg/m$^2$.

By using the so-obtained chromate-treated iron/tin/-nickel alloy-plated steel plate, an easy-open can lid was prepared in the same manner as described in Example 1, and the tests were conducted in the same manner as described in Example 1. The obtained results are shown in Table 1.

EXAMPLE 6

The same cold-rolled steel plate as used in Example 2 was subjected to alkali degreasing and pickling preliminary treatments according to customary procedures, and the steel plate was preheated by immersion in a flux maintained at 350° C. and was then immersed in a molten aluminum bath to obtain an aluminum-plated steel plate having a plated aluminum amount of 1000 mg/m$^2$. Then, the aluminum-plated steel plate was subjected to a cathodic electrolytic treatment in an aqueous solution containing 30 g/l of sodium dichromate to form a chromate film having a plated chromium amount of 15 mg/m$^2$.

By using the so-obtained chromate-treated aluminum-plated steel plate, an easy-open can lid was prepared in the same manner as described in Example 1. The tests were conducted in the same manner as described in Example 1. The obtained results are shown in Table 1.

COMPARATIVE EXAMPLE 1

The same cold-rolled steel plate as used in Example 2 was subjected to alkali degreasing and pickling preliminary treatments according to customary procedures and was then subjected to a cathodic electrolytic treatment at a current density of 30 A/dm$^2$ and a temperature of 40° C. in a chromium plating solution containing 250 g/l of chromic anhydride, 2.5 g/l of sulfuric acid and 1 l of water to form a chromium plating layer having a thickness corresponding to 250 mg/m$^2$.

By using the so-obtained chromium-plated steel plate, an easy-open can lid was prepared in the same manner as described in Example 1, and the tests were conducted in the same manner as described in Example 1. The obtained results are shown in Table 1.

COMPARATIVE EXAMPLE 2

By using the same cold-rolled steel plate as used in Example 2, a nickel-plated steel plate having a nickel plating layer having a thickness corresponding to 300 mg/m$^2$ was prepared in the same manner as described in Example 2. By using the so-obtained nickel-plated steel plate, an easy-open can lid was prepared in the same manner as described in Example 1. The tests were conducted in the same manner as described in Example 1. The obtained results are shown in Table 1.

COMPARATIVE EXAMPLE 3

By using the same cold-rolled steel plate as used in Example 2, an iron/tin alloy-plated steel plate having a plated tin amount of 500 mg/m$^2$ was prepared in the same manner as described in Example 3.

By using the so-obtained iron-tin alloy-plated steel plate, an easy-open can lid was prepared in the same manner as described in Example 1. The tests were conducted in the same manner as described in Example 1. The obtained results are shown in Table 1.

COMPARATIVE EXAMPLE 4

By using the same cold-rolled steel plate as used in Example 2, a tin/nickel alloy-plated steel plate having a plated tin amount of 500 mg/m$^2$ and a plated nickel amount of 300 mg/m$^2$ was prepared in the same manner as described in Example 4.

By using the so-obtained tin nickel alloy-plated steel plate, an easy-open can lid was prepared in the same manner as described in Example 1. The tests were conducted in the same manner as described in Example 1. The obtained results are shown in Table 1.

COMPARATIVE EXAMPLE 5

By using the same cold-rolled steel plate as used in Example 2, an aluminum-plated steel plate having a plated aluminum amount of 1000 mg/m$^2$ was prepared in the same manner as described in Example 6.

By using the so-obtained aluminum-deposited steel plate, an easy-open can lid was prepared in the same manner as described in Example 1. The tests were conducted in the same manner as described in Example 1. The obtained results are shown in Table 1.

From the results of Examples 1 through 6 and Comparative Examples 1 through 5, it is seen that when an electrolytically chromate-treated steel plate, a chromate-treated nickel-plated steel plate, a chromate-treated iron/tin alloy-plated steel plate, a chromate-treated tin/nickel alloy-plated steel plate, a chromate-treated iron/tin/nickel alloy-plated steel plate or chromate-treated aluminum-plated steel plate is selected and used among various surface-treated steel plates, excellent easy-open can lids can be obtained.

TABLE 1

| | Surface-Treated Steel Plate | Amount ($mg/m^2$) of Chromium in Chromate Film | Open-ability Test | Content: Bonito seasoned with soy sauce | | Content: Orange | |
|---|---|---|---|---|---|---|---|
| | | | | Stored Can Openability Test (I) | Observation of Inner Face of Easy-Open Can Lid | Stored Can Openability Test (II) | Observation of Inner Face of Easy-Open Can Lid |
| Example 1 | electrolytically chromic acid-treated steel plate | 15 | 100 | 100 | no change | 100 | no change |
| Example 2 | chromate-treated nickel-plated steel plate | 8 | 100 | 100 | " | 100 | " |
| Example 3 | chromate-treated iron/tin alloy-plated steel plate | 7 | 100 | 100 | " | 100 | " |
| Example 4 | chromate-treated tin/nickel alloy-plated steel plate | 8 | 100 | 100 | " | 100 | " |
| Example 5 | chromate-treated iron/tin/nickel alloy-plated steel plate | 10 | 100 | 100 | " | 100 | " |
| Example 6 | chromate-treated aluminum-plated steel plate | 15 | 100 | 100 | " | 100 | " |
| Comparative Example 1 | chromium-plated steel plate | 1 | 2 | 0 | spot rusting in scored portion | 0 | spot rusting in scored portion |
| Comparative Example 2 | nickel-plated steel plate | 0 | 1 | 0 | pitting in scored portion | 0 | spot rusting in scored portion |
| Comparative Example 3 | iron/tin alloy-plated steel plate | 0 | 8 | 0 | pitting in scored portion | 1 | spot rusting in scored portion |
| Comparative Example 4 | tin/nickel alloy-plated steel plate | 0 | 10 | 0 | spot rusting in scored portion | 2 | spot rusting in scored portion |
| Comparative Example 5 | aluminum-plated steel plate | 0 | 8 | 0 | spot rusting in scored portion | 1 | spot rusting in scored portion |

In Examples 7 through 14 and Comparative Examples 6 and 7, experiments were carried out by changing the adhesive and the bonding temperature.

EXAMPLE 7

By using the same electrolytically chromic acid-treated steel plate as used in Example 1, an easy-open can lid was prepared in the same manner as in Example 1 except that a film of nylon 6,10 was used as the adhesive and the bonding temperature was changed to 260° C. The openability test and the stored can openability test were conducted. The obtained results are shown in Table 2.

EXAMPLE 8

An easy-open can lid was prepared in the same manner as described in Example 7 except that a film of nylon 6,6 was used as the adhesive and the bonding temperature was changed to 300° C. The openability test and the stored can openability test were conducted. The obtained results are shown in Table 2.

EXAMPLE 9

An easy-open can lid was prepared in the same manner as described in Example 7 except that a film of a nylon 12/nylon 6 copolymer was used as the adhesive and the bonding temperature was changed to 240° C. The openability test and the stored can openability test were conducted. The obtained results are shown in Table 2.

EXAMPLE 10

An easy-open can lid was prepared in the same manner as described in Example 7 except that a polyamide formed by polycondensation from dimer acid, polyalkylene polyamine and hexamethylene diamine was used as the adhesive and coated in a thickness of 50 μm on the tab by using a hot melt applicator provided with a gear pump and the bonding temperature was changed to 240° C. The openability test and the stored can openability test were conducted. The obtained results are shown in Table 2.

EXAMPLE 11

An easy-open can lid was prepared in the same manner as described in Example 7 except that a polyamide prepared by polycondensation from dimer acid and polyalkylene polyamine was used as the adhesive and coated in a thickness of 50 μm on the tab by using a hot melt applicator provided with a gear pump and the bonding temperature was changed to 140° C. The openability test and the stored can openability test were conducted. The obtained results are shown in Table 2.

EXAMPLE 12

An easy-open can lid was prepared in the same manner as described in Example 7 except that a film of a copolyester derived from terephthalic acid, sebacic acid, 1,4-butanediol and triethylene glycol was used as the adhesive and the bonding temperature was changed to 240° C. The openabilty test and the stored can openability test were conducted. The obtained results are shown in Table 2.

EXAMPLE 13

An easy-open can lid was prepared in the same manner as described in Example 7 except that a film of a blend of a polyethylene terephthalate type copolyester and a polybutylene terephthalate type copolyester was used as the adhesive and the bonding temperature was changed to 230° C. The openability test and the stored can openability test were conducted. The obtained results are shown in Table 2.

EXAMPLE 14

An easy-open can lid was prepared in the same manner as described in Example 7 except that a copolyester derived from therephthalic acid, isophthalic acid, sebacic acid and 1,4-butanediol was used as the adhesive and coated in a thickness of 50 μm on the tab by a hot melt applicator provided with a gear pump and the bonding temperature was changed to 120° C. The openability test and the stored can openability test were conducted. The obtained results are shown in Table 2.

COMPARATIVE EXAMPLE 6

An easy-open can lid was prepared in the same manner as described in Example 7 except that a film of maleic anhydride-modified polypropylene was used as the adhesive and the bonding temperature was changed to 210° C. The openability test and the stored can openability test were conducted. The obtained results are shown in Table 2.

COMPARATIVE EXAMPLE 7

An easy-open can lid was prepared in the same manner as described in Example 7 except that an ethylene/vinyl acetate copolymer was used as the adhesive and coated in a thickness of 50 μm on the tab by using a hot melt applicator provided with a gear pump and the bonding temperature was changed to 140° C. The openability test and the stored can openability test were conducted. The obtained results are shown in Table 2.

From the results of Examples 7 through 14 and Comparative Examples 6 and 7, it is seen that when thermoplastic adhesives comprising amide recurring units and/or ester recurring units are selected and used among various adhesives, excellent easy-open can lids are obtained.

In Examples 15 through 22 and Comparative Examples 8 through 10, experiments were carried out by changing the kinds of the primer lacquer and adhesive.

EXAMPLE 15

By using the same electrolytically chromic acid-treated steel plate as used in Example, an easy-open can lid was prepared in the same manner as described in Example 1 except that an epoxy-phenolic lacquer (comprising 80% by weight of an epoxy resin and 20% by weight of a phenolic resin) was used as the primer lacquer, a film of nylon 6,10 was used as the adhesive and the bonding temperature was changed to 260° C. The openability test was conducted. The obtained results are shown in Table 3.

EXAMPLE 16

Procedures of Example 15 were repeated in the same manner except that an epoxy-phenolic lacquer comprising 65% by weight of an epoxy resin and 35% by weight of a phenolic resin was used as the primer lacquer. The obtained results are shown in Table 3.

EXAMPLE 17

Procedures of Example 15 were repeated in the same manner except that an epoxy-phenolic lacquer comprising 35% by weight of an epoxy resin and 65% by weight of a phenolic resin was used as the primer lacquer. The obtained results are shown in Table 3.

EXAMPLE 18

An easy-open can lid was prepared in the same manner as described in Example 1 except that a copolyester derived from terephthalic acid, sebacic acid, 1,4-butanediol and triethylene glycol was used as the adhesive and the bonding temperature was changed to 230° C. The openability test was conducted. The obtained results are shown in Table 3.

TABLE 2

| | Adhesive | Melting or Softening Temperature (°C.) | Openability Test | Content: Flavored Bonito Stored Can Openability Test (I) | Content: Orange Stored Can Openability Test (II) |
|---|---|---|---|---|---|
| Example 7 | nylon 6,10 | 225 | 100 | 100 | 100 |
| Example 8 | nylon 6,6 | 265 | 100 | 100 | 100 |
| Example 9 | nylon 12/nylon 6 copolymer | 195 | 100 | 100 | 100 |
| Example 10 | polyamide formed by polycondensation from dimer acid, polyalkylene polyamine and hexamethylene diamine | 200 | 100 | 100 | 100 |
| Example 11 | polyamide formed by polycondensation from dimer acid and polyalkylene polyamine | 95 | 100 | 65 | 100 |
| Example 12 | copolyester derived from terephthalic acid, sebacic acid, 1,4-butanediol and triethylene glycol | 195 | 100 | 100 | 100 |
| Example 13 | blend of polyethylene terephthalate type copolyester and polybutylene terephthalate type copolyester | 180 | 100 | 100 | 100 |
| Example 14 | copolyester derived from terephthalic acid, sebacic acid and 1,4-butanediol | 70 | 100 | 40 | 100 |
| Comparative Example 6 | maleic anhydride-modified polypropylene | 167 | 0 | 0 | 0 |
| Comparative Example 7 | ethylene/vinyl acetate copolymer | 100 | 0 | 0 | 0 |

EXAMPLES 19 THROUGH 22 AND COMPARATIVE EXAMPLES 8 THROUGH 10

Procedures of Example 18 were repeated in the same manner except that an epoxy/urea lacquer (comprising 90% by weight of an epoxy resin and 10% by weight of a urea resin), an epoxy/ester lacquer, a vinyl chloride organosol lacquer (containing 15% by weight of an epoxy/phenolic lacquer), an epoxy-modified vinyl lacquer (thermosetting vinyl lacquer), a vinyl chloride/vinyl acetate copolymer type straight vinyl lacquer, a solution type polyester lacquer or a thermosetting acrylic lacquer was used as the primer lacquer. The obtained results are shown in Table 3.

From the results of Examples 15 through 22 and Comparative Examples 8 through 10, it is seen that when epoxy type primers are selected and used among various primers, excellent easy-open can lids can be obtained.

TABLE 3

| | Primer | Adhesive | Openability Test |
|---|---|---|---|
| Example 15 | epoxy/phenolic (80% by weight of epoxy resin and 20% by weight of phenolic resin) | nylon 6,10 (softening point of 225° C.) | 100 |
| Example 16 | epoxy/phenolic (65% by weight of epoxy resin and 35% by weight of phenolic resin) | nylon 6,10 (softening point of 225° C.) | 100 |
| Example 17 | epoxy/phenolic (35% by weight of epoxy resin and 65% of phenolic resin) | nylon 6,10 (softening point of 225° C.) | 100 |
| Example 18 | epoxy/phenolic (90% by weight of epoxy resin and 10% by weight of phenolic resin) | copolyester derived from terepthalic acid, sebacic acid, 1,4-butanediol and triethylene glycol (softening point of 195° C.) | 100 |
| Example 19 | epoxy/urea (90% by weight of epoxy resin and 10% by weight of urea resin) | copolyester derived from terephthalic acid, sebacic acid, 1,4-butanediol and triethylene glycol (softening point of 195° C.) | 100 |
| Example 20 | epoxy/ester | copolyester derived from terephthalic acid, sebacic acid, 1,4-butanediol and triethylene glycol (softening point of 195° C.) | 100 |
| Example 21 | vinyl chloride organosol (containing 15% by weight of epoxy/phenolic lacquer) | copolyester derived from terephthalic acid, sebacic acid, 1,4-butanediol and triethylene glycol (softening point of 195° C.) | 100 |
| Example 22 | epoxy-modified vinyl lacquer (thermosetting vinyl lacquer) | copolyester derived from terephthalic acid, sebacic acid, 1,4-butanediol and triethylene glycol (softening point of 195° C.) | 100 |
| Comparative Example 8 | vinyl chloride/vinyl acetate copolymer straight vinyl lacquer | copolyester derived from terephthalic acid, sebacic acid, 1,4-butanediol and triethylene glycol (softening point of 195° C.) | 0 |
| Comparative Example 9 | solution type polyester lacquer | copolyester derived from terephthalic acid, sebacic acid, 1,4-butanediol and triethylene glycol (softening point of 195° C.) | 0 |
| Comparative Example 10 | thermosetting acrylic lacquer | copolyester derived from terephthalic acid, sebacic acid, 1,4-butanediol and triethylene glycol (softening point of 195° C.) | 0 |

In Examples 23 through 26 and Comparative Examples 11 and 12, experiments were carried out by using surface-treated steel plates, which were the same in the carbon content, thickness and surface treatment but different in the elongation, as the surface-treated steel plate for the can lid without changing the kinds of the primer and adhesive, the distance between the score line and bonding fulcrum, the width of the adhesive layer at the fulcrum and the resiudal thickness on the score line.

EXAMPLES 23 THROUGH 26

Molten steel was decarburized and deoxidized by a vacuum degassing treatment, and according to the conventional strip process, the steel was bloom-rolled and hot-rolled to a thickness of 2.3 mm. Then, the steel was pickled and subjected to primary cold rolling while changing the reduction ratio, followed by box annealing. The annealed steel was subjected to secondary cold rolling at a reduction ratio of 43%., 35%, 25% or 20%. Thus, steel plates having a thickness of 0.20 mm and an elongation shown in Table 4, which were used in Examples 23 through 26, were prepared. The elongations and carbon contents of these steels are shown in Table 4.

Each of the so-prepared steel plates was converted to a tin-free steel (TFS) plate having a non-metallic chromium amount of 15 mg/m$^2$ and a metallic chromium amount of 100 mg/m$^2$ through an ordinary electrolytic chromic acid treatment line. An epoxy/phenolic type lacquer was coated on both the surfaces of the steel plate so that the thickness after coating was 5 $\mu$m, followed by baking at 210° C. for 10 minutes. The coated TFS plate was formed into a lid having a nominal diameter of 211 by using a press. A sealing compound was coated and dried on the curl portion according to customary procedures. Then, the outer surface of the lid was subjected to scoring processing to form a circular score line having a diameter of 58 mm in which the residual thickness/steel plate thickness ratio was 0.23. A tab prepared from a coated TFS plate having a thickness of 0.36 mm was bonded at 220° C. to the so-obtained lid member by a filmy adhesive of nylon 12 so that the distance between the score line and the bonding fulcrum was 6 mm and the width of the adhesive layer at the bonding fulcrum was 5 mm.

With respect to each of the so-obtained easy-open can lids, the above-mentioned initial opening force $P_I$ and gradual opening force $P_G$ were measured by using an Instron type tensile tester. Formation of cracks in the scored portion was checked by using an impregnating crack detector. The obtained results are shown in Table 4.

COMPARATIVE EXAMPLES 11 AND 12

Steel plates used in Comparative Examples 11 and 12 were prepared in the same manner as in Examples 23 through 26 except that the reduction ratio at the secondary cold rolling step was changed to 5% or 2%. The carbon contents and elongations of the obtained steel plates are shown in Table 4.

Conversion to TFS, primer coating, lid formation, scoring processing, tab formation and tab bonding were carried out in the same manner as in Examples 23 through 26. With respect to each of the so-obtained easy-open can lids, the opening force was measured and formation of cracks in the scored portion was checked. The obtained results are shown in Table 4.

In Examples 27 through 29 and Comparative Example 13, experiments were carried out by using steel plates, which were the same as in the thickness and elongation but different in the carbon content, as the surface-treated steel plate for the can lid without changing the kinds of the primer and adhesive, the distance between the score line and the bonding fulcrum, the width of the adhesive layer at the bonding fulcrum and the residual thickness of the scored portion.

EXAMPLES 27 THROUGH 29 AND COMPARATIVE EXAMPLE 13

Steel plates having a thickness of 0.18 mm, which were used in Examples 27 and 28, were prepared in the same manner as in Examples 23 through 26 except that a predetermined carbon content was obtained by the decarburizing annealing after primary cold rolling without performing decarburization by vacuum degassing and the reduction ratio at the secondary cold rolling step was adjusted to 25% or 20%. Incidentally, in case of the steel used in Example 28, decarburization was intentionally stopped in the midway so as to obtain a predetermined carbon level.

Steel plates used in Example 29 and Comparative Exmaple 13 were obtained by subjecting a steel having a low carbon level, which was prepared by performing melting, pouring, hot rolling, primary cold rolling and box annealing according to customary procedures, to secondary cold rolling at a reduction ratio of 20% or 15%.

The carbon contents and elongations of these steel plates are shown in Table 4.

Easy-open can lids were prepared from these steel plates by performing conversion to TFS, primer coating, lid formation, scoring processing, tab formation and tab bonding in the same manner as in Examples 23 through 26. The opening force was measured and formation of cracks in the scored portion was checked. The obtained results are shown in Table 4.

From the results of Examples 23 through 29 and Comparative Examples 11 through 13, it is seen that when steel plates having a carbon content lower than 0.03% and an elongation of 1 to 20% are selected among various steel plates and used for the production of easy-open can lids, the initial opening force $P_I$ is small and the gradual opening force $P_G$ is large to some extent, and the obtained can lids are excellent in the easy openability.

In Examples 30 through 33 and Comparative Example 14 through 16, experiments were carried out by changing the score residual thickness/original plate thickness ratio without changing the kinds of the primer and adhesive, the distance between the score line and the bonding fulcrum, the width of the adhesive layer at the bonding fulcrum and the carbon content, thickness, elongation and surface treatment of the surface-treated steel plate used for the lid.

EXAMPLES 30 THROUGH 33 AND COMPARATIVE EXAMPLES 14 THROUGH 16

Easy-open can lids of Examples 30 through 33 and Comparative Examples 14 through 16 were prepared in the same manner as in Examples 23 through 26 except that the reduction ratio at the secondary cold rolling step was adjusted to 25% and the ratio of the residual thickness on the score line to the thickness of the steel plate was adjusted to 0.15, 0.25, 0.30, 0.38, 0.09, 0.42 or 0.48. The opening force was measured and formation of cracks in the score portion was checked. The obtained results are shown in Table 4.

From the results of Examples 30 through 33 and Comparative Examples 14 through 16, it is seen that in order to obtain an easy-open can lid in which cracks are not formed in the scored portion, the sealing property is excellent and the opening force is small, it is important that the ratio of the residual thickness on the score line to the thickness of the surface-treated steel plate should be adjusted within the range of from 0.10 to 0.40.

TABLE 4

| | Elongation (%) of Steel Plate | Carbon Content (% by weight) in Steel Plate | (surface-treated steel plate thickness = 0.20 mm) Score Residual Thickness/ Original Plate Thickness | Opening Force (kg) Initial Opening Force ($P_I$) | Opening Force (kg) Gradual Opening Force ($P_G$) | Scoring Processability |
|---|---|---|---|---|---|---|
| Example 23 | 3 | 0.010 | 0.23 | 4.3 | 1.3 | normal |
| Example 24 | 10 | 0.010 | 0.23 | 5.0 | 1.5 | " |
| Example 25 | 14 | 0.010 | 0.23 | 5.2 | 1.7 | " |
| Example 26 | 20 | 0.010 | 0.23 | 6.5 | 1.7 | " |
| Comparative Example 11 | 26 | 0.010 | 0.23 | 9.0 | 1.8 | partially cracked |
| Comparative Example 12 | 30 | 0.010 | 0.23 | 11.0 | 1.8 | " |

TABLE 4-continued

| | Elongation (%) of Steel Plate | Carbon Content (% by weight) in Steel Plate | (surface-treated steel plate thickness = 0.20 mm) Score Residual Thickness/ Original Plate Thickness | Opening Force (kg) Initial Opening Force ($P_I$) | Gradual Opening Force ($P_G$) | Scoring Processability |
|---|---|---|---|---|---|---|
| Example 27 | 11 | 0.005 | 0.23 | 5.1 | 1.5 | normal |
| Example 28 | 10 | 0.019 | 0.23 | 5.0 | 1.5 | " |
| Example 29 | 10 | 0.030 | 0.23 | 4.9 | 0.5 | " |
| Comparative Example 13 | 9 | 0.051 | 0.23 | 5.0 | 0.3 | partially cracked |
| Example 30 | 7 | 0.015 | 0.15 | 3.5 | 0.9 | normal |
| Example 31 | 7 | 0.015 | 0.25 | 5.5 | 1.6 | " |
| Example 32 | 7 | 0.015 | 0.30 | 6.2 | 1.8 | " |
| Example 33 | 7 | 0.015 | 0.38 | 7.0 | 2.0 | " |
| Comparative Example 14 | 7 | 0.015 | 0.09 | 3.2 | 0.3 | partially cracked |
| Comparative Example 15 | 7 | 0.015 | 0.42 | 14.5 | 2.2 | normal |
| Comparative Example 16 | 7 | 0.015 | 0.48 | opening was impossible by peeling of tab. | | " |

In Examples 34 and 35 and Comparative Examples 17 through 21, experiments were carried out by changing the method of bonding the tab to the lid member.

EXAMPLE 34

An easy-open can lid was prepared in the same manner as in Examples 23 through 26 except that TFS having a carbon content of 0.005% and an elongation of 5% was used as the starting steel for the lid and a film of nylon 6,10 was used as the adhesive, and the bonding temperature was changed to 260° C. The openability test was carried out. Furthermore, after bonding the tab to the lid member, an epoxy-phenolic lacquer was coated on the inner and outer faces of the lid by spraying, followed by heating baking at 200° C. for 5 minutes. A can No. 7 having one end seamed with the so-obtained easy-open can lid was filled with flavored bonito, and the other end of the can was vacuum-seamed with an ordinary lid. Then, the filled can was heat-sterilized at 116° C. for 90 minutes and was then stored at normal temperature for 1 year. The corrosion state of the inner face of the easy-open lid was observed by a stereomicroscope.

EXAMPLE 35

An easy-open can lid was prepared in the same manner as described in Example 34 except that a copolyester derived from terephthalic acid, isophthalic acid, sebacic acid and 1,4-butanediol was used as the adhesive and coated in a thickness of 50 μm on the tab by using a hot melt applicator provided with a gear pump and the bonding temperature was changed to 120° C. The openability test was carried out and the state of corrosion after storing of the filled can was checked. The obtained results are shown in Table 5.

COMPARATIVE EXAMPLE 17

An easy-open can lid was prepared in the same manner as described in Example 34 except that a film of maleic anhydride-modified polypropylene was used as the adhesive and the bonding temperature was changed to 210° C. The openability test was carried out and the state of corrosion after storing of the filled can was checked. The obtained results are shown in Table 5.

COMPARATIVE EXAMPLE 18

An easy-open can lid was prepared in the same manner as described in Example 34 except that the tab was bonded to the lid member by soldering at 230° C. The openability test was carried out and the state of corrosion after storing of the filled can was checked. The obtained results are shown in Table 5.

COMPARATIVE EXAMPLE 19

An easy-open can lid was prepared in the same manner as described in Example 34 except that the tab was bonded to the lid member by shaving off the primer coating from the steel plate at the bonding part and performing resistance welding under a compressive force of 30 to 60 kg at an electric current of 3000 A. The openability test was carried out and the state of corrosion after storing of the filled can was checked. The obtained results are shown in Table 5.

COMPARATIVE EXAMPLE 20

An easy-open can lid was prepared in the same manner as described in Example 34 except that the tab was bonded to the lid member by ultrasonic welding under a compressive force of 50 to 100 kg. The openability test was carried out and the state of corrosion after storing of the field can was checked. The obtained results are shown in Table 5.

COMPARATIVE EXAMPLE 21

An easy-open can lid was prepared in the same manner as described in Example 34 except that the tab was bonded to the lid member by performing riveting processing and mechanical caulking according to the conventional technique of forming an easy-open can lid. The openability test was carried out and the state of corrosion after storing of the filled can was checked. The obtained results are shown in Table 5.

From the results of Examples 34 and 35 and Comparative Examples 17 through 21, it is seen that if bonding using a thermoplastic adhesive consisting of amide recurring units and/or ester recurring units is selected for bonding a tab to a lid member composed of a primer-coated chromated surface treated steel plate among various bonding methods, an excellent easy-open can lid can be obtained.

TABLE 5

| | Tab-Bonding Method | Opening Force (kg) Initial opening force ($P_I$) | Gradual opening force ($P_G$) | Corrosion Resistance |
|---|---|---|---|---|
| Example 34 | bonding with nylon 6,10 adhesive | 4.3 | 1.3 | no change |
| Example 35 | bonding with adhesive of copolyester derived from terephthalic acid, isophthalic acid, sebacic acid and 1,4-butanediol | 4.3 | 1.3 | " |
| Comparative Example 17 | bonding using maleic anhydride-modified polypropylene adhesive | opening was impossible by peeling of tab | — | " |
| Comparative Example 18 | soldering | opening was impossible by peeling of tab | — | pitting in bonded portion |
| Comparative Example 19 | resistance welding | 4.4 | 1.3 | " |
| Comparative Example 20 | ultrasonic welding | 4.3 | 1.3 | " |
| Comparative Example 21 | mechanical bonding with rivet | 4.4 | 1.3 | leakage by cracking of rivet |

We claim:

1. An easy-open can lid having on the periphery thereof a sealing compound-coated portion to be seamed with a flange of a can body and an easy-open mechanism on the inner side, said can lid comprising a rigid lid member comprising a chromated surface treated steel plate coated with an epoxy type primer, a score line formed on the lid member to define a portion to be opened which is cut to the middle of the steel plate in the thickness direction, and an opening tab secured to the outer surface of the lid member at said portion to be opened through a bonding fulcrum formed of a thermoplastic adhesive consisting of amide recurring units and/or ester recurring units, said opening tab being located so that the push-tearing top end of the opening tab is positioned substantially on the score line, wherein the chromated surface treated steel plate has a thickness of 0.10–0.40 mm, a strength of 35–60 kg/mm$^2$, a carbon content of lower than 0.03% and an elongation of 1 to 20%, and the ratio of the residual thickness on the score line to the thickness of the chromated surface treated steel plate in the portion to be initially opened is in the range of from 0.1 to 0.4.

2. An easy-open can lid having on the periphery thereof a sealing compound-coated portion to be seamed with a flange of a can body and an easy-open mechanism on the inner side, said can lid comprising a rigid lid member comprising a chromated surface treated steel plate coated with an epoxy type primer, a score line formed on the lid member to define a portion to be opened which is cut to the middle of the steel plate in the thickness direction thereof, and an opening tab secured to the outer surface of the lid member at said portion to be opened through a bonding fulcrum formed of a thermoplastic adhesive consisting of amide recurring units and/or ester recurring units, said opening tab being located so that the push-tearing top end of the opening tab is positioned substantially on the score line, wherein the opening tab is formed so that the following requirement is satisfied:

$$W \geqq K \cdot d \cdot \delta_B \cdot t^2$$

wherein K is a constant having a value of 4 kg$^{-1}$, d stands for a distance (mm) between the score line and the bonding fulcrum, $\delta_B$ stands for the tensile strength (kg/mm$^2$) of the surface-treated steel plate, t stands for the residual thickness (mm) of the lid member on the score line and W stands for the width (mm) of the adhesive layer at the distance d from the score line, the chromated surface treated steel plate has a thickness of 0.12–0.35 mm, a strength of 35–60 kg/mm$^2$, a carbon content of lower than 0.03% and an elongation of 1 to 20%, and the ratio of the residual thickness on the score line to the thickness of the chromated surface treated steel plate in the portion to be initially opened is in the range of from 0.1 to 0.4.

3. An easy-open can lid as set forth in claim 1, wherein the chromated surface treated steel plate is an electrolytically chromic acid-treated steel plate, a chromate-treated nickel deposited steel plate, a chromate-treated iron/tin alloy-deposited steel plate, a chromate-treated tin/nickel alloy-deposited steel plate, a chromate-treated iron/tin/nickel alloy-deposited steel plate, a chromate-treated aluminum-deposited steel plate or a chromate-treated nickel/tin-deposited steel plate.

4. An easy-open can lid as set forth in claim 2, wherein the chromated surface treated steel plate is an electrolytically chromic acid-treated steel plate, a chromate-treated nickel-deposited steel plate, a chromate-treated iron/tin alloy deposited steel plate, a chromate-treated tin/nickel alloy-deposited steel plate, a chromate-treated iron/tin/nickel alloy-deposited steel plate, a chromate-treated aluminum-deposited steel plate or a chromate-treated nickel/tin-deposited steel plate.

5. An easy-open can lid according to claim 1, wherein the chromated surface treated steel plate has a carbon content lower than 0.02%, an elongation of 1 to 15%, a ratio of residual thickness on the score line of 0.15 to 0.25 and a rolled aggregate crystal texture.

6. An easy-open can lid according to claim 2 having an initial opening force ($P_I$) that is controlled to a preferred level of 2.5 to 7.5 kg and a gradual opening force ($P_G$) that is controlled to a preferred level of 0.5 to 2.0 kg.

7. An easy-open can lid according to claim 3 wherein the chromated surface treated steel plate is an electrolytically chromic acid-treated steel plate comprising a cold rolled steel plate substrate, a metallic chromium layer formed on the substrate and a non-metallic chromium layer formed on the metallic chromium layer, wherein the steel plate substrate has a thickness of 0.1 to 0.4 mm, the amount of chromium deposited in the metallic layer is 30 to 300 mg/m$^2$ and the amount of chromium deposited in the non-metallic layer is 4 to 40 mg/m$^2$.

8. An easy-open can lid according to claim 3 wherein the chromated surface treated steel plate is a chromate-treated iron/tin alloy-plated steel plate comprising a cold rolled steel plate substrate, an iron/tin ally layer formed on the substrate and a chromate layer formed on the alloy layer, wherein the amount plated of the alloy calculated as the amount of tin is 30 to 800 mg/m$^2$ and the chromate layer comprises a non-metallic chromium layer alone or further contains a metallic chromium layer wherein the amount plated of chromium is 3 to 200 mg/m$^2$.

9. An easy-open can lid according to claim 3 wherein the chromated surface treated steel plate is a chromate-treated tin/nickel alloy-plated steel plate comprising a cold rolled steel substrate, a tin/nickel alloy layer formed on the substrate and a chromate layer formed on the alloy layer, wherein the amount plated of the alloy calculated as the amount of tin is 30 to 800 mg/m$^2$ and the chromate layer comprises a non-metallic chromium layer alone or further contains a metallic chromium layer and the amount plated of chromium is 3 to 200 mg/m$^2$.

10. An easy-open can lid according to claim 9 wherein the tin/nickel alloy layer further incorporates a small amount of iron, manganese, zinc, molybdenum or copper.

11. An easy-open can lid according to claim 3 wherein the chromated surface treated steel plate is a chromate-treated iron/tin/nickel alloy-plated steel plate comprising a cold rolled steel plate substrate, an iron/tin/nickel alloy layer formed on the substrate and a chromate layer formed on the alloy layer, wherein the amount plated of the alloy layer calculated as the amount of tin is 10 to 800 mg/m$^2$, the chromate layer comprises a non-metallic chromium layer alone or further contains a metallic chromium layer and the amount deposited of chromium is 3 to 200 mg/m$^2$.

12. An easy-open can lid according to claim 3 wherein the chromated surface treated steel plate is a chromate-treated aluminum-plated steel plate comprising a cold rolled steel plate substrate, an aluminum layer formed on the substrate and a chromate layer formed on the aluminum layer, wherein the amount plated of aluminum is 30 to 3,000 mg/m$^2$, the chromate layer comprises a non-metallic chromium layer alone or further contains a metallic chromium layer and the amount plated of chromium is 3 to 200 mg/m$^2$.

13. An easy-open can lid according to claim 12 wherein the chromate layer is a chromium phosphate layer.

* * * * *